US010415356B2

(12) United States Patent
Mickey et al.

(10) Patent No.: US 10,415,356 B2
(45) Date of Patent: Sep. 17, 2019

(54) INSERT FOR WELL PLUGS AND METHOD

(71) Applicant: TEAM OIL TOOLS, LP, The Woodlands, TX (US)

(72) Inventors: Clint Mickey, San Antonio, TX (US); Mark Reddout, The Woodlands, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 222 days.

(21) Appl. No.: 15/281,436

(22) Filed: Sep. 30, 2016

(65) Prior Publication Data

US 2017/0101845 A1 Apr. 13, 2017

Related U.S. Application Data

(60) Provisional application No. 62/239,522, filed on Oct. 9, 2015.

(51) Int. Cl.

| | |
|---|---|
| ***E21B 34/10*** | (2006.01) |
| ***E21B 43/26*** | (2006.01) |
| ***E21B 33/134*** | (2006.01) |
| ***E21B 33/128*** | (2006.01) |

(52) U.S. Cl.

CPC ..... *E21B 43/26* (2013.01); *E21B 33/1285* (2013.01); *E21B 33/134* (2013.01)

(58) Field of Classification Search

CPC ..... E21B 33/1208; E21B 34/063; E21B 34/10

See application file for complete search history.

(56) References Cited

U.S. PATENT DOCUMENTS

| | | | | |
|---|---|---|---|---|
| 4,846,281 | A * | 7/1989 | Clary | E21B 34/063 166/373 |
| 6,799,638 | B2 * | 10/2004 | Butterfield, Jr. | E21B 33/16 166/177.3 |
| 2005/0274527 | A1 * | 12/2005 | Misselbrook | E21B 17/203 166/369 |
| 2013/0062055 | A1 * | 3/2013 | Tolman | E21B 23/00 166/250.01 |
| 2014/0000894 | A1 * | 1/2014 | Coffey | E21B 43/117 166/297 |

* cited by examiner

*Primary Examiner* — Catherine Loikith

(74) *Attorney, Agent, or Firm* — MH2 Technology Law Group LLP

(57) ABSTRACT

A downhole plug, an insert for a downhole plug, and a method for plugging a well. The insert includes a body configured to be disposed at least partially within a seat of the plug, and a first obstructing member coupled with the body. The first obstructing member is configured to substantially obstruct a bore through the body and to be removed from the body when a predetermined actuation pressure is applied.

20 Claims, 9 Drawing Sheets

INSERT FOR WELL PLUGS AND METHOD

CROSS-REFERENCE TO RELATED APPLICATIONS

This application claims priority to U.S. Provisional Patent Application Ser. No. 62/239,522, which was filed on Oct. 9, 2015 and is incorporated herein by reference in its entirety.

BACKGROUND

In the oilfield industry, various downhole tools (e.g., bridge plugs and frac plugs) may be used to isolate sections of a well. Accordingly, the plugs are typically designed and built to hold thousands of pounds of pressure, e.g., about ten thousand or more pounds of pressure axially across the plug.

Generally, the well is pressure tested after a bridge plug or frac plug is in place and functioning to isolate the well sections. Occasionally, the pressure test reveals a failure in the casing, or otherwise has a negative result. Further, a perforating gun assembly may also be positioned in the well, near the plug. Perforating guns are employed in the hydraulic fracturing operations to perforate the casing, and to propagate cracks in the subterranean formation. Occasionally, the perforating guns may fail to fire. If the pressure test fails or the perforating guns fail to fire, the perforating guns are typically removed from the well. Once the perforating gun is repaired or replaced, and/or the casing issue revealed by the pressure test is addressed, the perforating gun is generally run back into the well. However, because the well is plugged by the tool, fluid flow is not available to pump the perforating gun back into place. Accordingly, a tractor is employed to mechanically move the perforating gun into place, which is generally a slower process.

SUMMARY

Embodiments of the disclosure may provide an insert for a downhole plug. The insert includes a body configured to be disposed at least partially within a seat of the plug, and a first obstructing member coupled with the body. The first obstructing member is configured to substantially obstruct a bore through the body and to be removed from the body when a predetermined actuation pressure is applied.

Embodiments of the disclosure may also include a downhole plug for a well including a mandrel defining a bore at least partially axially therethrough, and an insert positioned at least partially within the mandrel. The insert includes a first obstructing member that obstructs fluid communication through the bore. Further, the first obstructing member is configured to be removed when a pressure within the well reaches a predetermined actuation pressure.

Embodiments of the disclosure may further provide a method for selectively plugging a well. The method includes deploying a plug and a tool into a well, with the plug including an insert having a first obstructing member that prevents fluid flow therethrough. The method also includes removing the tool from the well while the plug remains in the well, and increasing a pressure in the well to at or above an actuation pressure of the plug. Increasing the pressure to at or above the actuation pressure causes the first obstructing member to be removed, allowing fluid communication through the plug. The method further includes redeploying the tool into the well after the first obstructing member is removed.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1:
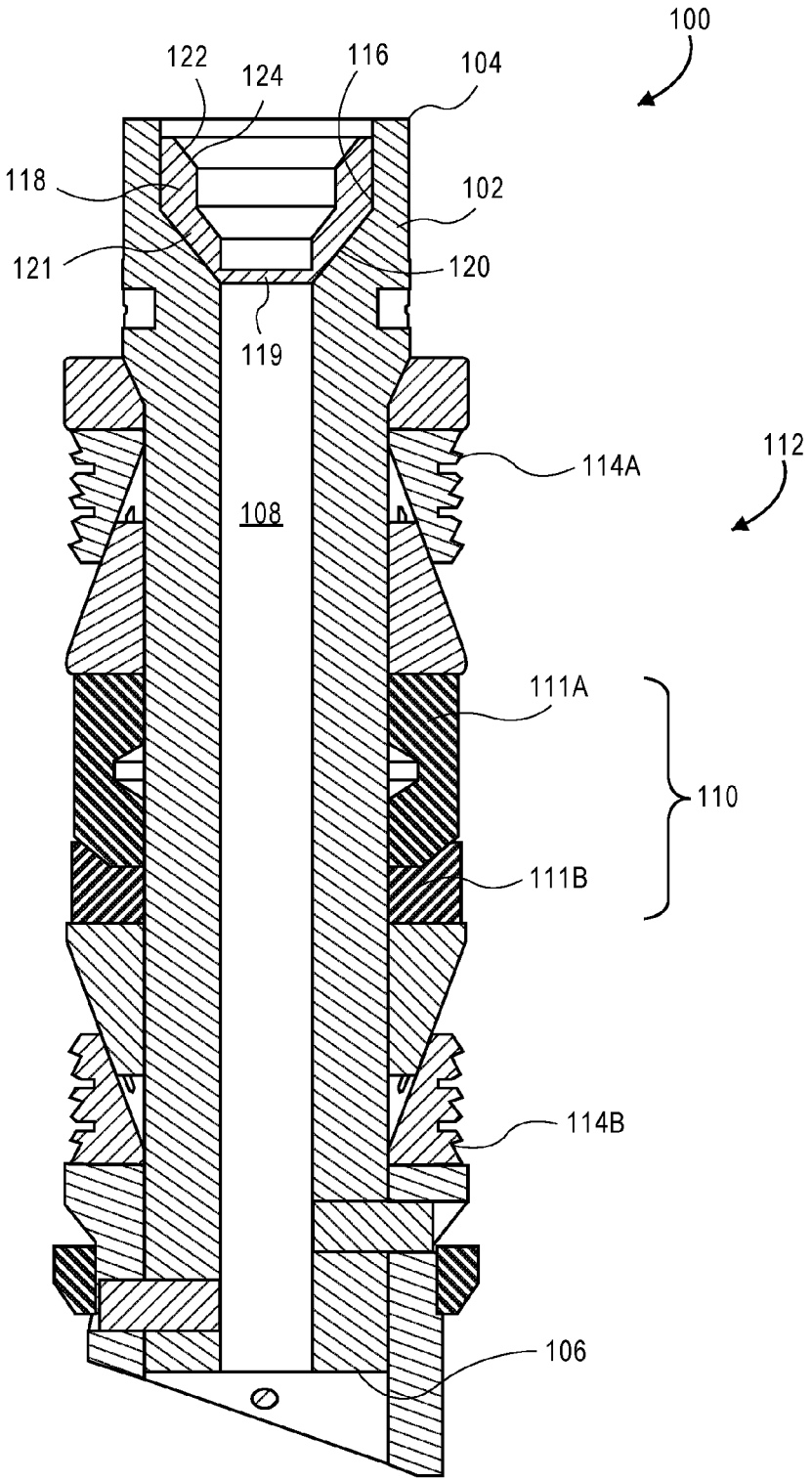
FIG. 1 illustrates a side, cross-sectional view of a downhole plug in a first closed configuration, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, the present disclosure provides an insert for use in a downhole plug that is deployed into a well. Optionally, the insert may be attached within the seat of a standard or "off the shelf" plug (e.g., ball-drop frac plug), which may provide the standard plug with additional functionality. The insert may include an obstructing member, such as a burst disk or a bullet (or both), which may obstruct (e.g., substantially prevent) fluid flow though the mandrel of the downhole plug. If needed, for example, if the perforating gun fails or otherwise is removed, the mandrel may be opened by applying increased pressure into the well, thereby rupturing the burst disk or pushing the bullet out of the mandrel. Accordingly, the perforating gun may be deployed back into the well with the aid of fluid flow, since the downhole plug may allow fluid communication therethrough. A second obstructing member, such as a drop ball, may then be deployed into a seat provided by the insert, so as to again block fluid communication through the mandrel.

Turning now to the illustrated embodiments, FIG. 1 illustrates a side, cross-sectional view of a downhole plug 100 in a first closed configuration, according to an embodiment. The downhole plug 100 may be configured as a bridge plug, a frac plug, or any other type of plug configured to be run into a well with initial flow-through capability. The downhole plug 100 may include a mandrel 102 having a first or "upper" end 104, and a second or "lower" end 106, with a bore 108 extending axially within the mandrel 102, between the first and second ends 104, 106. The mandrel 102 may be at least partially formed from a composite (e.g., a fiber-reinforced material), but in other embodiments, may be steel, cast iron, etc.

The term "axially" is used herein to refer to a direction parallel to a longitudinal axis (along the centerline of the mandrel 102) of the downhole plug 100. The term "radially" refers to a direction normal to the longitudinal axis. The term "circumferential" refers to a direction extending around the longitudinal axis. Further, directional terms such as "above," "below," "upper," "lower," "top," "bottom," and the like are used to refer to the relative positioning of components in the figure, which are generally shown in the orientation in which the embodiment of the downhole plug 100 may be run in the well (i.e., bottom first). However, it will be appreciated that these directional terms are not to be considered in an absolute sense. For example, in a horizontal section of a well, the downhole plug 100 may be in a horizontal orientation, and thus the "top" may be to the side of the "bottom," but the present description of the relative positioning of the components would still apply.

The downhole plug 100 may also include a sealing assembly 110 including one or more radially-expandable sealing elements 111A, 111B, as well as a setting assembly 112, including one or more radially-expandable slips 114A, 114B. The sealing assembly 110 and the setting assembly 112 may be received around the mandrel 102. The sealing assembly 110 may be axially-compressible and radially-expandable to seal with a surrounding tubular (e.g., casing or well), and the setting assembly 112 may be axially-compressible and radially-expandable so as engage the surrounding tubular and prevent displacement of the downhole plug 100 with respect thereto. Such expansion, (at least partial) sealing, and engagement may be referred to as "setting" the downhole plug 100. It will be appreciated that the illustrated sealing assembly 110 and setting assembly 112 are merely examples and are not to be considered limiting unless otherwise expressly stated herein.

The mandrel 102 may include a seat 116 that may extend downward from the first end 104, so as to define a continuation (e.g., a part of) of the bore 108. The seat 116 may have a larger diameter than the bore 108, and may, in some embodiments, be configured to receive a ball, dart, or other obstructing member that may be deployed into a well.

In the illustrated embodiment, the downhole plug 100 includes an insert 118 received into the seat 116. The insert 118 may include a body 121 having a first obstructing member, which may be, for example, a bridge or "burst disk" 119 spanning the bore 108, so as to prevent fluid flow through the bore 108. The burst disk 119 may be configured to rupture at a predetermined actuation pressure, e.g., above a pressure at which the casing, in which the downhole plug 100 is deployed, is tested. In a specific embodiment, the casing pressure test may occur at 10 kpsi, and the burst disk 119 may be configured to rupture at a higher pressure, such as, for example, about 10.5 kpsi. Such rupture may result in removal of the first obstructing member.

The insert 118 may be secured within the seat 116. For example, the body 121 of the insert 118 may include threads on an outside thereof, which may mesh with threads formed in the seat 116, so as to secure the insert 118 within the seat 116. In other embodiments, however, the insert 118 may be welded, adhered, brazed, fastened, etc. with the mandrel 102, so as to be secured to the mandrel 102.

The seat 116 may have an inwardly-tapered (frustoconical) surface 120. The seat 116 may decrease in diameter as proceeding downward, toward the second end 106, along the surface 120. The insert 118 may have a shape that corresponds to the tapered shape of the seat 116, such that forces on the insert 118 generated by downward pressure on the insert 118 may be transmitted to the mandrel 102 at least partially via the tapered surface 120.

The insert 118 may also include a seat 122 within the body 121. The seat 122 may include an inwardly-tapered (frustoconical) surface 124, e.g., at or near the top of the insert 118, such that, proceeding downward, toward the second end 106, the surface 124 may decrease in diameter. The seat 122 may thus be configured to catch a ball, dart, or any other type of "second" obstructing member that may be deployed into the well. Accordingly, in some embodiments, a smaller second obstructing member than would be used to obstruct the seat 116 of the mandrel 102 without the insert 118 may be employed to obstruct the seat 122 of the insert 118. In other embodiments, the taper angle of the surface 124 may dictate that a same or similar sized second obstructing member is used. In either example, the seat 122 may perform the same function, serving to catch the second obstructing member and thereby block the bore 108, e.g., after the burst disk 119 is ruptured, as will be described in greater detail below.

The insert 118 may be provided for applications where pressure-testing the well (e.g., casing disposed therein) is called for. If such pressure testing is not to be conducted, or initial blocking or bridging of the well is otherwise not called for, the insert 118 may not be received into the mandrel 102, or may optionally be removed from the mandrel 102. In such case, without the insert 118, the downhole plug 100 may provide a standard, "off the shelf" plug, which may have capabilities as a ball-drop frac plug, or another type of plug with flow-through capabilities.

Figure 2:
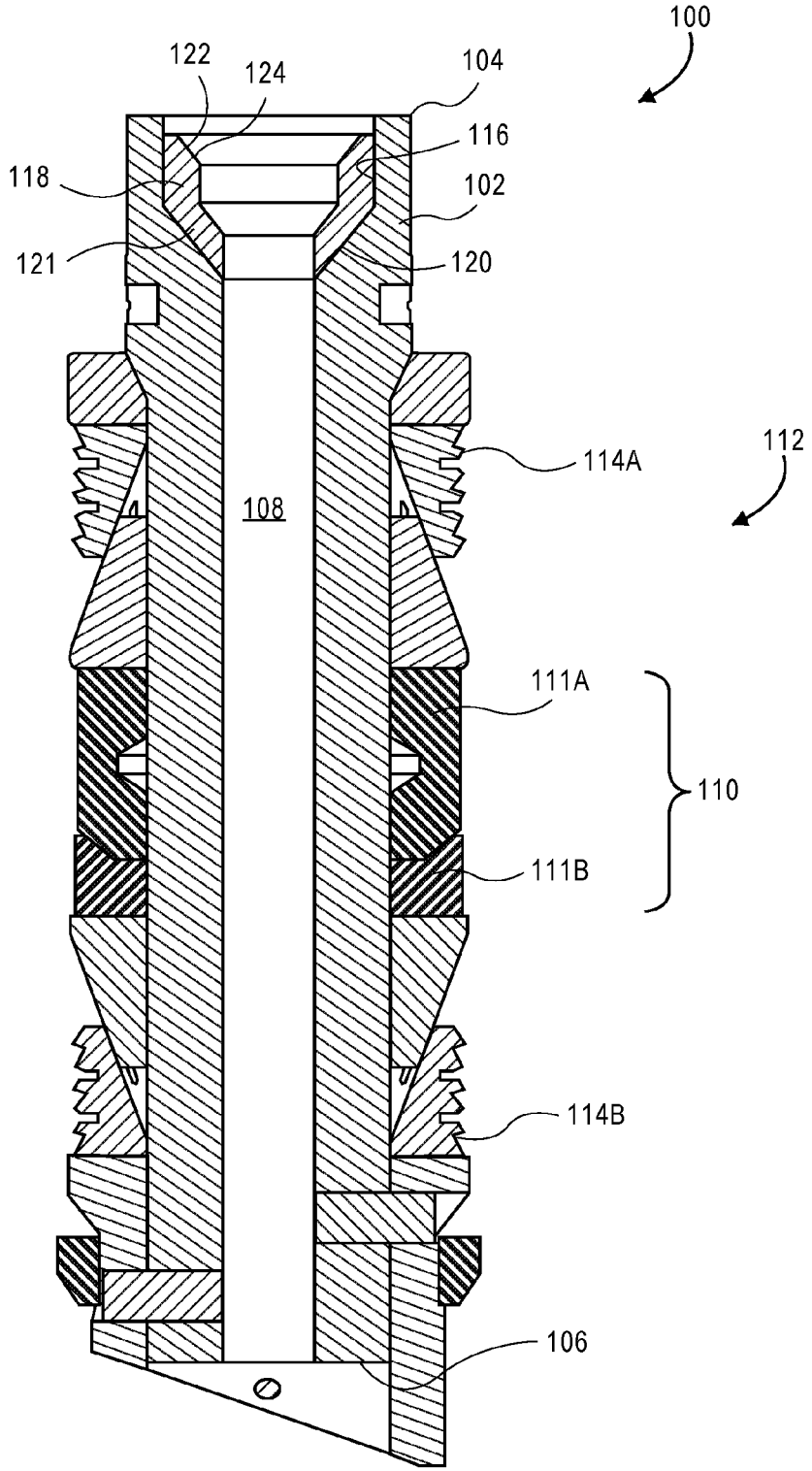
FIG. 2 illustrates a side, cross-sectional view of the downhole plug in an open configuration, according to an embodiment.

Referring now to FIG. 2, there is shown a side, cross-sectional view of the downhole plug 100 in an open configuration, according to an embodiment. As noted above, the burst disk 119 (FIG. 1) may be configured to be ruptured at a predetermined threshold, i.e., an actuation pressure, thereby effective removal of the first obstructing member. FIG. 2 illustrates a view of the downhole plug 100 after such rupturing has occurred, e.g., the burst disk 119 is no longer attached to a remainder of the insert 118. As can be seen, access through the full inner diameter of the bore 108 may be provided by removal of the burst disk 119, such that the insert 118 does not act as an upset within the bore 108 or otherwise restrict the flowpath area or limit the size of tools that can be passed through the bore 108.

Figure 3:
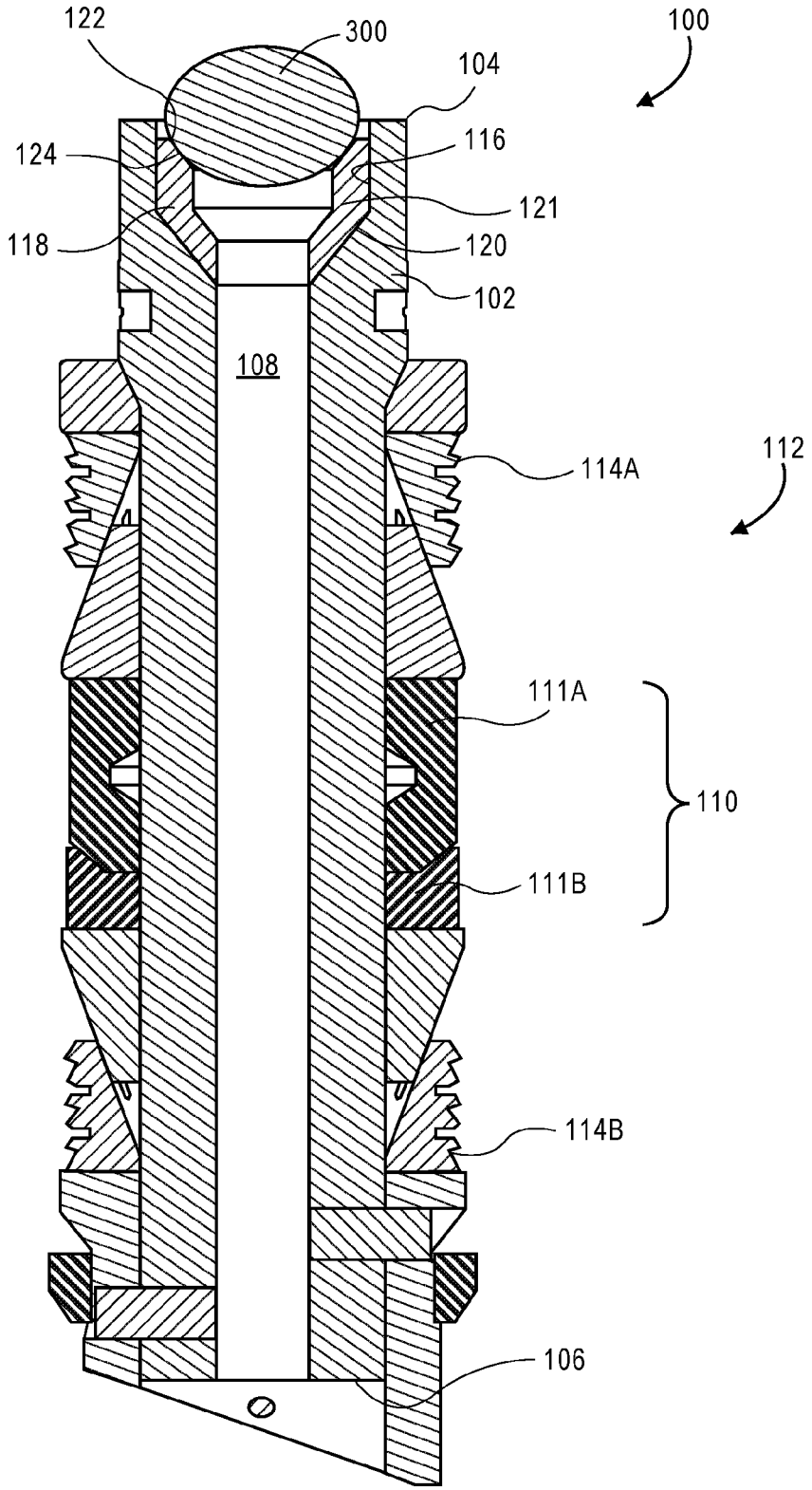
FIG. 3 illustrates a side, cross-sectional view of the downhole plug in a second closed configuration, according to an embodiment.

With the first obstructing member removed (e.g., the burst disk 119 (FIG. 1) has ruptured), flow may be allowed through the body 121 and through the bore 108. At some point, it may be desired to stop such flow, such as for subsequent pressure testing, hydraulic fracturing operations, or other operations in the well. Accordingly, FIG. 3 illustrates a side, cross-sectional view of the downhole plug 100 in a second closed configuration, according to an embodiment. As shown, a second obstructing member 300, which may be, as illustrated, a ball, but in other embodiments, may be a dart or any other suitable object, may be deployed into the well and caught by the seat 122 of the insert 118. The second obstructing member 300 may obstruct flow through the bore 108 via engagement with the surface 124 of the insert 118. Forces generated by pressure from above on the second obstructing member 300 may be transmitted via the insert 118 to the mandrel 102, which may be secured in place by the setting assembly 112.

Although the insert 118 is shown in and described above with reference to FIGS. 1 and 2 as positioned at or near the top of the mandrel 102, it will be appreciated that the insert 118 may be located at any position along the bore 108, e.g., at or near the second end 106 and/or at any position between the first and second ends 104, 106. Further, the insert 118 may be collocated with the seat 116, as described above, or may be separately retained in the mandrel 102, e.g., above or below the seat 116.

Figure 4:
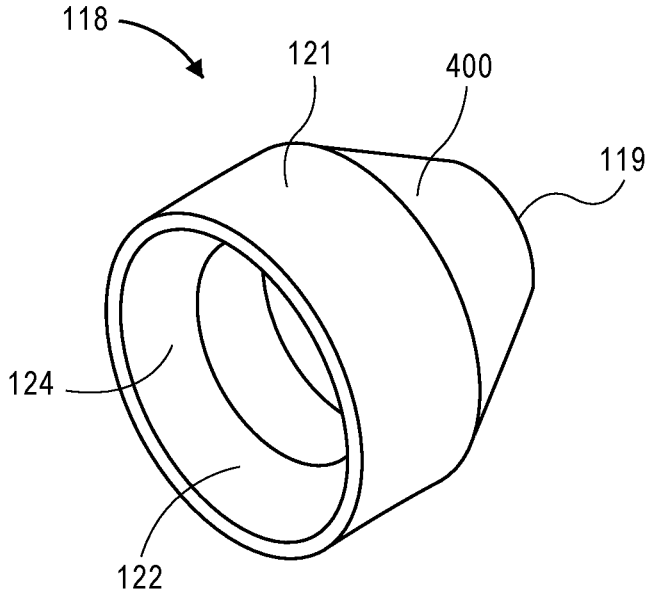
FIGS. 4 and 5 illustrate perspective views of a burst disk insert of the downhole plug, according to an embodiment.
Figure 5:
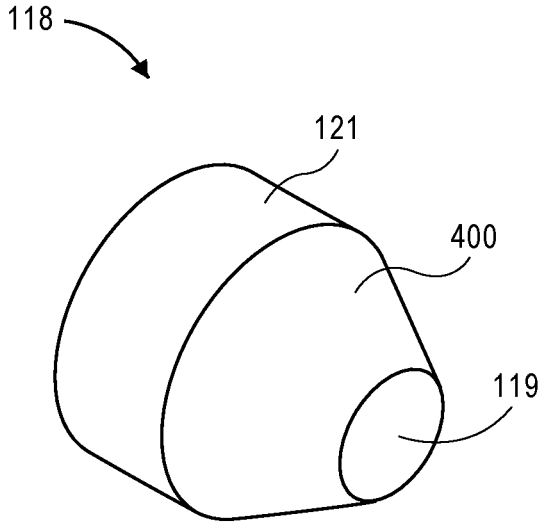

FIGS. 4 and 5 illustrate perspective views of the insert 118, according to an embodiment. As shown, the body 121 of the insert 118 may have a tapered outer surface 400, which may correspond in shape to the seat 116 of the mandrel 102 (FIGS. 1-3) so as to be received snugly therein. The tapered outer surface 400 may extend to the burst disk 119, which may, in some embodiments, form the lower wall of the insert 118, thereby closing the bottom of the insert 118. The top of the body 121 may be open, and may define the seat 122 with the tapered surface 124 for catching the second obstructing member 300 (e.g., FIG. 3).

Figure 6:
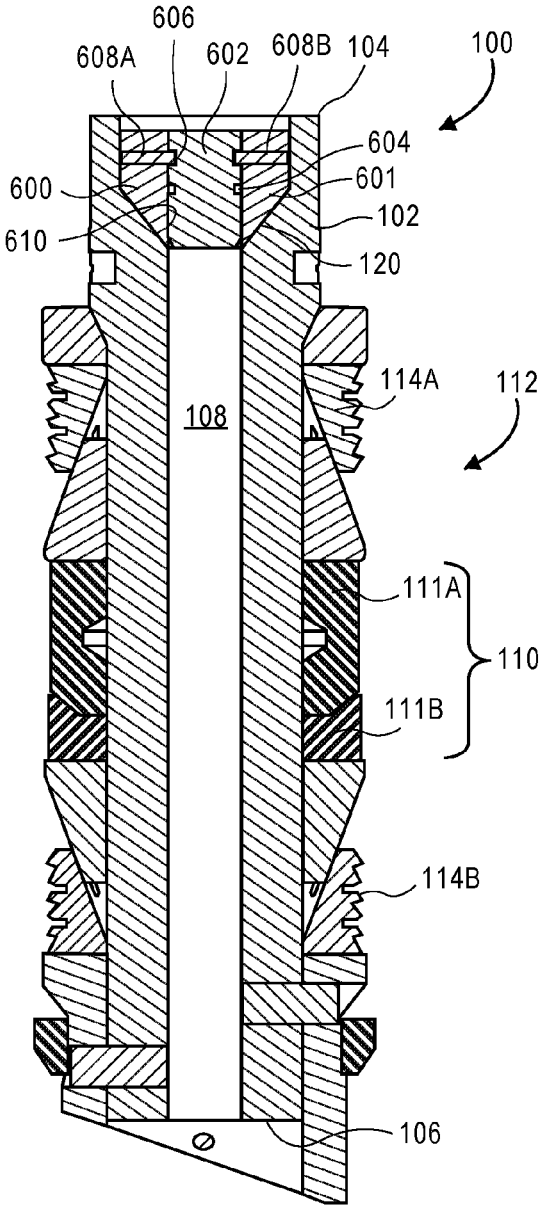
FIG. 6 illustrates a side, cross-sectional view of another embodiment of the downhole plug in a closed configuration.

FIG. 6 illustrates a side, cross-sectional view of another embodiment of the downhole plug 100 in a closed configuration. The downhole plug 100 of FIG. 6 may generally include the sealing and setting assemblies 110, 112, e.g., as discussed above. Further, the downhole plug 100 may include an insert 600 disposed in the mandrel 102 proximal to the upper end 104, e.g., in the seat 122 thereof, similar to the insert 118. The insert 600 may include a body 601, which may be coupled with a first obstructing member. The first obstructing member of the insert 600 may, for example, be provided by a bullet 602 that may be temporarily secured to the body 601. The term "bullet" is intended to broadly refer to any structure that is capable of obstructing the bore 108 and being pushed out of the bore 108 by pressure in the well.

The bullet 602 may be generally elongated in the axial direction (i.e., parallel to the longitudinal axis of the mandrel 102). Further, the bullet 602 may include one or more seals 604 and at least one groove 606 extending radially inwards into the bullet 602. In some embodiments, the groove 606 may extend circumferentially around the bullet 602, but in other embodiments may be segmented into several circumferentially-separated grooves 606. Furthermore, in some embodiments, the grooves 606 may be provided as holes, e.g., blind holes, bored radially into the bullet 602.

Figure 7:
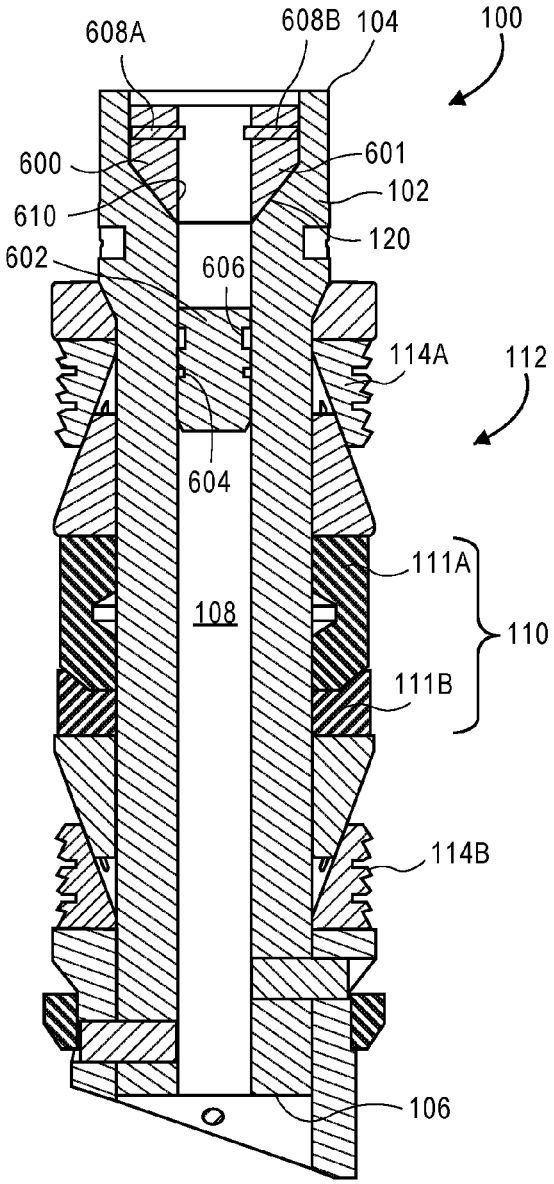
FIG. 7 illustrates a side, cross-sectional view of the downhole plug of FIG. 6 in the process of transitioning to an open configuration, according to an embodiment.
Figure 8:
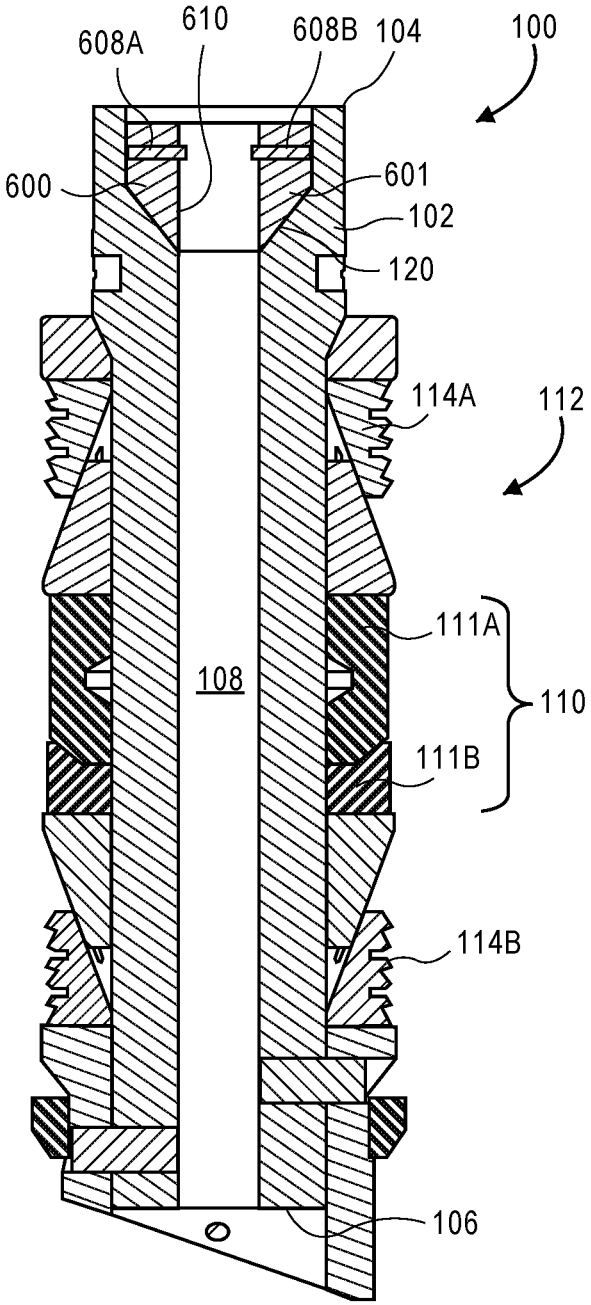
FIG. 8 illustrates a side, cross-sectional view of the downhole plug of FIGS. 6 and 7 in the open configuration, according to an embodiment.

The insert 600 may also include one or more shearable members (two shown: 608A, 608B). The shearable members 608A, 608B may be shear screws, shear pins, shear threads, or any other type of shearable member configured to engage and retain the bullet 602 until a predetermined force (e.g., as generated by the predetermined actuation pressure) is applied thereto. Upon application of such predetermined force, the shearable member(s) 608A, 608B may shear (break), releasing the bullet 602. Since the well above the first end 104 may experience a relatively high pressure, which may generate the force on the bullet 602, the bullet 602, once released from the insert 600, may proceed toward the second end 106 of the mandrel 102, as shown in FIG. 7. As shown in FIG. 8, once the bullet 602 exits the bore 108, the bore 108 may be open for fluid communication through the mandrel 102 (i.e., the downhole plug 100 is in an "open configuration").

In an embodiment, the body 601 of the insert 600 may not include a tapered inner surface or seat, but may instead provide a straight-through bore 610, which may have the same diameter, or a similar diameter, as the bore 108, thereby serving as a continuation of the bore 108. Omission of the tapered seat may provide additional thickness in the body 601, so as to support the shearable members 608A, 608B. However, in other embodiments, the insert 600 may provide a tapered surface, similar to the seat 122 of the insert 118 (e.g., FIG. 6).

Figure 9:
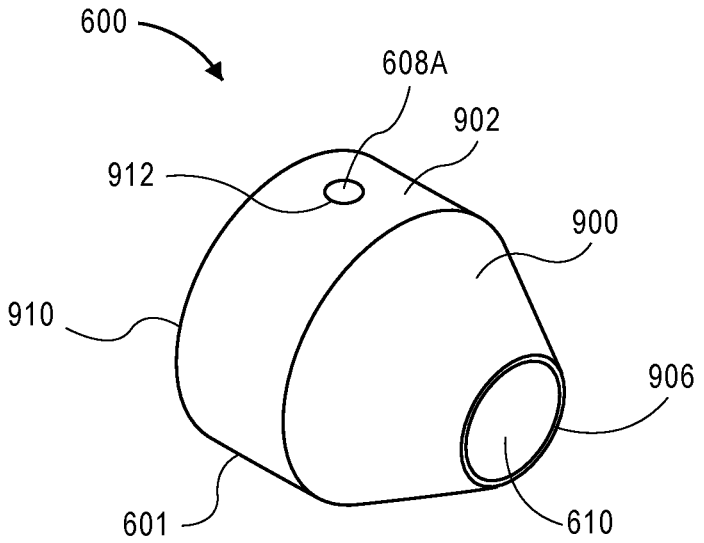
FIGS. 9 and 10 illustrate perspective views of another insert, according to an embodiment.
Figure 10:
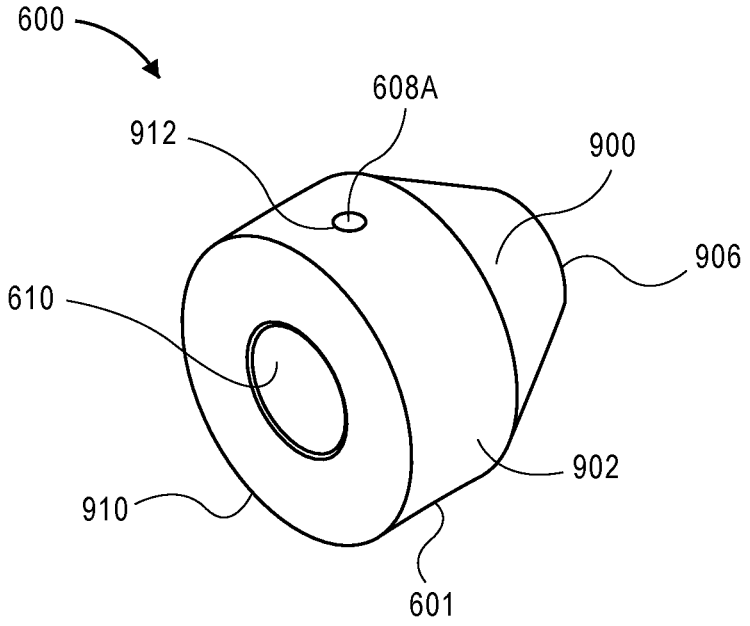

FIGS. 9 and 10 illustrate two perspective views of the insert 600, according to an embodiment. As shown, the body 601 of the insert 600 includes a tapered section 900 and a cylindrical section 902. The tapered section 900 may extend from the cylindrical section 902 to a lower end 906 of the body 601. The lower end 906 may be open. The cylindrical section 902 may extend from the tapered section 900 to an upper end 910 of the insert 600. The upper end 910 may also be open.

The shearable member 608A may be received through a hole 912 defined radially through the wall of the cylindrical section 902. Another hole (not visible) may be positioned about 180 degrees from the hole 912, to receive the shearable member 608B (FIGS. 6-8) therethrough. In some embodiments, three or more holes 912 may be provided, e.g., in embodiments that include the shearable members 608A, 608B and one or more additional shearable members. Further, the holes 912 may be uniformly distributed around the cylindrical section 902, but in other embodiments, may be at non-uniform intervals, and/or may be disposed in the tapered section 900. In other embodiments, the holes 912 may be provided as a groove formed continuously around the body 601.

In various embodiments, multiple inserts 118 may be provided with multiple different first obstructing members, configured to be removed at different pressures. For example, different burst disks 119 may be configured to rupture at different pressures. In another example, a single insert 118 may fit several different shearable members 608A, 608B, which may shear under different loads, and/or multiple inserts 118 with shearable members 608A, 608B of different shear strengths may be provided. Thus, by provision of a selection of inserts 118 (and/or a selection of first obstructing members within each or a single insert 118), a single downhole plug 100 may be provided for use at different pressures, which may provide additional flexibility in the application of the downhole plug 100.

The features of the embodiments shown in FIGS. 1-5 and 6-10, respectively, should not be considered mutually exclusive. Rather, in some embodiments, the insert 600 may include a seat, so as to catch a second obstructing member, thereby restricting or stopping fluid communication through the bore 108, and moving the downhole plug 100 into a second closed configuration. Further, the insert 600 may also include a burst disk, e.g., above or below the bullet 602, so as to further control opening of the bore 108.

Figure 11:
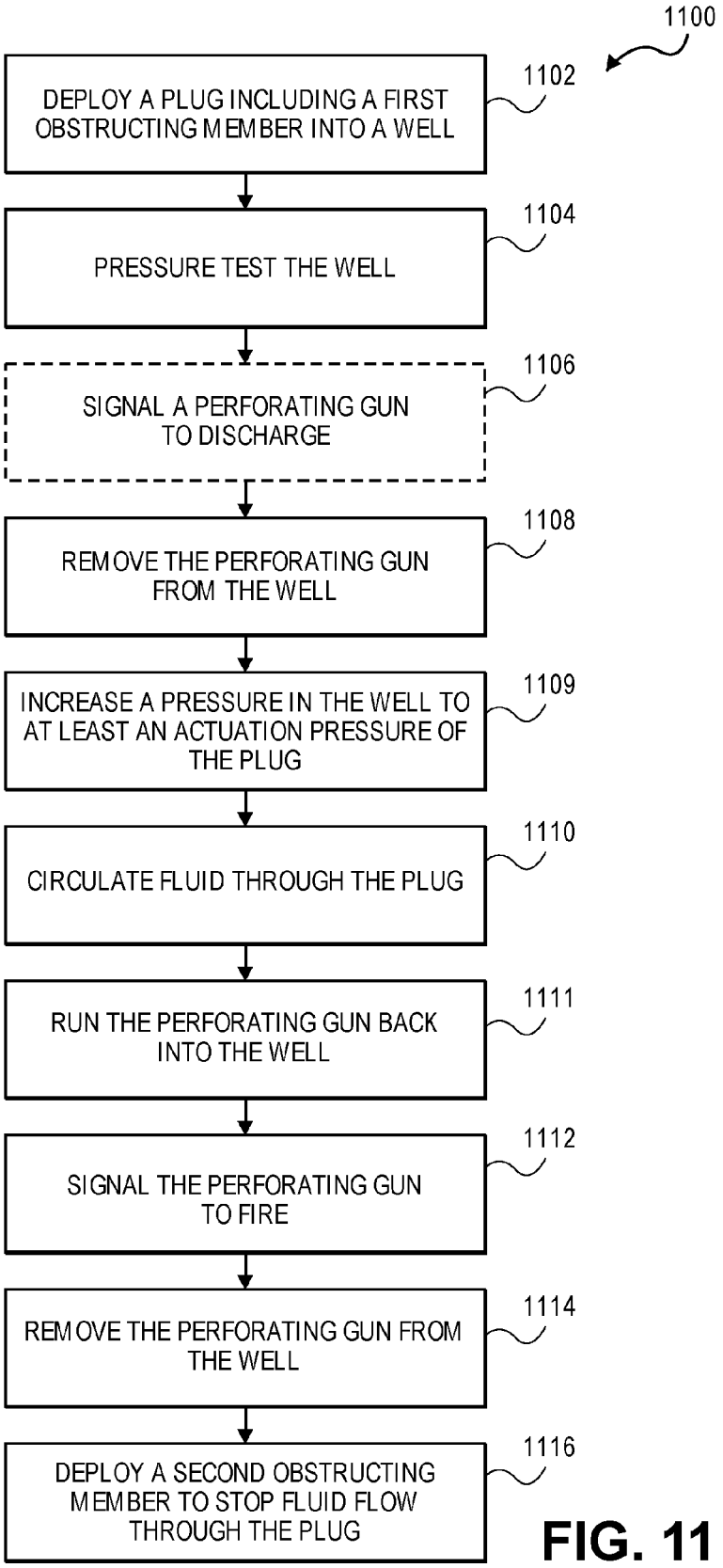
FIG. 11 illustrates a flowchart of a method for selectively plugging a well, according to an embodiment.
Figure 12:
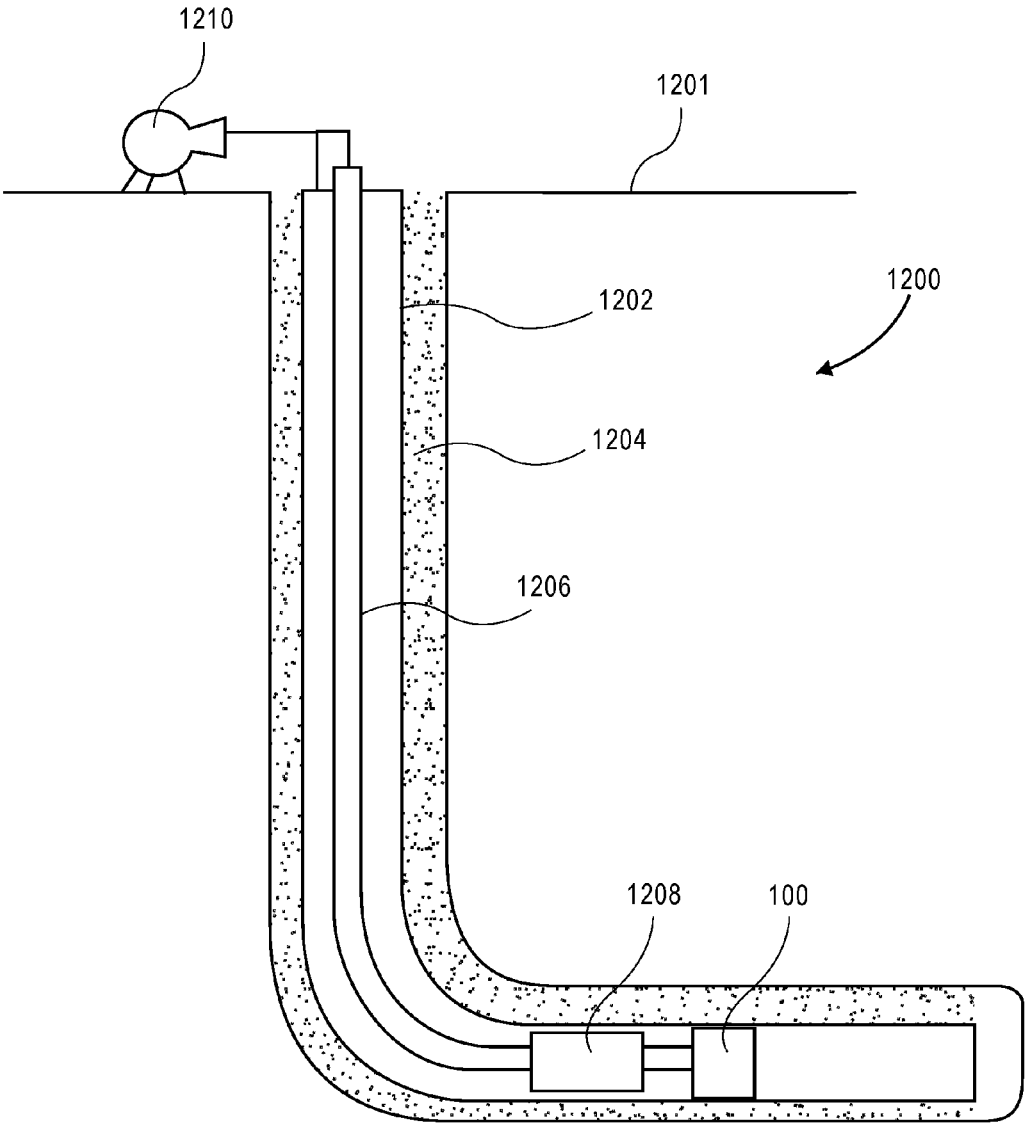
FIG. 12 illustrates a simplified schematic view of a well, according to an embodiment.

FIG. 11 illustrates a flowchart of a method 1100 for selectively plugging a well, according to an embodiment. The method 1100 may proceed using an embodiment of the downhole plug 100 discussed above, and thus the method 1100 will be described with reference thereto. However, some embodiments of the method 1100 may use other devices. Further, FIG. 12 illustrates a simplified, schematic view of a well 1200 in which the method 1100 and/or the downhole plug 100 may be employed, according to an embodiment. Although the well 1200 is illustrated as deviated, it will be appreciated that embodiments of the present disclosure may apply to wells of any geometry.

Referring now to FIGS. 11 and 12, the method 1100 may begin by deploying the downhole plug 100 into the well 1200, e.g., from a top surface 1201, as at 1102. The downhole plug 100 may be a frac plug of a standard variety, fitted with an embodiment of the insert 118 and/or 600 discussed above. In other embodiments, the downhole plug 100 may be tailored for use specifically with the insert 118 and/or 600.

With the provision of the insert 118, 600, fluid flow through the bore 108 of the downhole plug 100 may initially be prevented. The well 1200 may include a casing 1202, in at least some situations, although, in others, the downhole plug 100 may be deployed into an uncased or "open" hole. In the illustrated cased-hole, the well 1200 may also include an annulus 1204 that is at least partially filled with cement. When the downhole plug 100 reaches a desired location, the downhole plug 100 may be set, as at 1103, which may cause the sealing assembly 110 of the downhole plug 100 to substantially prevent fluid flow around the downhole plug 100.

In an embodiment, the downhole plug 100 may be run in the well 1200 on a wireline 1206 (coiled tubing, slick line, etc., may also or instead be employed) positioned within the casing 1202. The wireline 1206 may also include a tool, such as a perforating gun 1208, which may be run along with the downhole plug 100. The perforating gun 1208 may, for example, be located between the downhole plug 100 and the surface 1201. The well 1200 may also include one or more pumps 1210, configured to supply fluid into the well 1200, e.g., between the casing 1202 and the wireline 1206 and/or within the wireline 1206.

The method 1100 may also include pressure testing the well 1200 to a first pressure, as at 1104. The first pressure may be below the actuation pressure of the downhole plug 100. Optionally, the method 1100 may also include signaling the perforating gun 1208 to discharge, as at 1106, which, when successful, causes perforations to develop in the casing 1202, annulus 1204, and in the surrounding formation.

In some cases, the pressure test results may not be satisfactory (e.g., may fail) and/or the perforation gun 1208 may fail. In response to determining either or both conditions of failure, the perforation gun 1208 may be removed from the well, as at 1108. Before, during, or after removing the perforation gun 1208, the method 1100 may also include increasing a pressure within the casing 1202 to a second pressure, as at 1109, e.g., also in response to such failure conditions. The second pressure may be greater than the first pressure and may be greater than the actuation pressure of the downhole plug 100. As such, increasing the pressure to the second pressure may actuate the downhole plug 100 into the open position, providing for fluid flow through the downhole plug 100.

After actuating the downhole plug 100, and before, during, or after removing the perforating gun 1208 from the well 1200, the method 1100 may proceed to circulating fluid through the downhole plug 100, as at 1110. The method 1100 may also include running the perforating gun 1208 (to include embodiments in which a repaired or a replaced perforating gun is used) back into the well 1200, as at 1111, e.g., employing the fluid being circulated to assist in the (re)deployment of the perforating gun 1208. In some embodiments, this may occur after addressing issues related to a failed well pressure test.

Once the perforating gun 1208 is in place, the method 1100 may include signaling the perforating gun to fire, as at 1112. The perforating gun 1208 may then be removed from the well, as at 1114. The method 1100 may also include deploying the second obstructing member 300 (FIG. 3) into the well 1200, as at 1116. The second obstructing member 300 may be pumped into the well 1200 until it is caught by the downhole plug 100, thereby substantially preventing fluid flow past the downhole plug 100.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An insert for a downhole plug, comprising:

a body configured to be disposed at least partially within a seat of the plug, wherein the body comprises a tapered outer section that is received into a tapered surface of the seat of the plug; and a first obstructing member coupled with the body, the first obstructing member configured to substantially obstruct a bore through the body and to be removed from the body when a predetermined actuation pressure is applied, wherein the body further comprises an inner tapered surface configured to catch a second obstructing member.

2. The insert of claim 1, wherein the predetermined actuation pressure is higher than a well pressure testing pressure.

3. The insert of claim 1, wherein the first obstructing member comprises a burst disk configured to rupture at the predetermined actuation pressure.

4. The insert of claim 3, wherein the burst disk is positioned at a first end of the body, and wherein the body defines the inner tapered surface for catching the second obstructing member at a second end of the body.

5. The insert of claim 1, wherein the insert further comprises:

one or more shearable members coupled with the body; and a bullet disposed at least partially within the body and engaging the one or more shearable members, such that the one or more shearable members prevent the bullet from displacement relative to the body until a well pressure reaches the actuation pressure.

6. The insert of claim 5, wherein the bullet is expelled through the bore when the well pressure reaches the actuation pressure.

7. The insert of claim 1, wherein the body is configured to be coupled to the seat of the plug such that the body is stationary with respect to the seat of the plug at all times that the body is coupled to the plug.

8. A downhole plug for a well, comprising:

a mandrel defining a bore at least partially axially therethrough; and an insert positioned at least partially within the mandrel, the insert comprising a first obstructing member that obstructs fluid communication through the bore, the first obstructing member being configured to be removed when a pressure within the well reaches a predetermined actuation pressure, wherein the mandrel defines a tapered seat, the insert being shaped to be received and retained in the tapered seat, and wherein the insert comprises a body having an outer surface in engagement with the tapered seat, and an inner tapered surface for catching a second obstructing member.

9. The plug of claim 8, wherein the first obstructing member comprises a burst disk positioned at a first end of the body.

10. The plug of claim 9, wherein the body defines the inner tapered surface for catching the second obstructing member at a second end of the body.

11. The plug of claim 8, wherein:

the insert further comprises one or more shearable members coupled with the body; and the first obstructing member comprises a bullet disposed at least partially within the body and engaging the one or more shearable members, such that the one or more shearable members prevent the bullet from displacement relative to the body until a well pressure reaches the actuation pressure.

12. The plug of claim 11, wherein the bullet is expelled through the bore after the well reaches the actuation pressure.

13. A method for selectively plugging a well, comprising:

deploying a plug and a tool into a well, the plug including an insert having a first obstructing member that prevents fluid flow therethrough;

removing the tool from the well while the plug remains in the well;

increasing a pressure in the well to at or above an actuation pressure of the plug, wherein increasing the pressure to at or above the actuation pressure causes the first obstructing member to be removed, allowing fluid communication through the plug;

redeploying the tool into the well after the first obstructing member is removed;

performing a pressure test on the well at a pressure that is less than the actuation pressure, prior to removing the tool and prior to the first obstructing member being removed; and determining that the pressure test failed, wherein removing the tool is performed in response to determining that the pressure test failed.

14. The method of claim 13, wherein redeploying the tool comprises circulating fluid in the well, through the plug.

15. The method of claim 13, further comprising deploying a second obstructing member into engagement with the plug, to obstruct fluid communication through the plug, after the first obstructing member is removed.

16. The method of claim 15, wherein the insert comprises a tapered surface providing a seat for catching the second obstructing member.

17. The method of claim 13, wherein the first obstructing member comprises a burst disk, the burst disk being configured to rupture at the actuation pressure.

18. The method of claim 13, wherein the tool comprises a perforating gun.

19. The method of claim 18, further comprising:

signaling the perforating gun to fire; and determining that the perforating gun failed, wherein removing the tool comprises removing the perforating gun in response to determining that the perforating gun failed.

20. A method for selectively plugging a well, comprising:

deploying a plug and a tool into a well, the plug including an insert having a first obstructing member that prevents fluid flow therethrough;

removing the tool from the well while the plug remains in the well;

increasing a pressure in the well to at or above an actuation pressure of the plug, wherein increasing the pressure to at or above the actuation pressure causes the first obstructing member to be removed, allowing fluid communication through the plug; and redeploying the tool into the well after the first obstructing member is removed, wherein the insert comprises one or more shearable members, and the first obstructing member comprises a bullet held in place relative to a body of the insert by the one or more shearable members, and wherein, when the pressure in the well is increased to the actuation pressure, the one or more shearable members shear, and the bullet is pushed through a bore of the plug and out of an end thereof.

* * * * *